US009526282B2

(12) United States Patent
Green et al.

(10) Patent No.: US 9,526,282 B2
(45) Date of Patent: Dec. 27, 2016

(54) GLOVE

(75) Inventors: Daniel Allan Green, Okotoks (CA); Carl Moriarty, North Vancouver (CA)

(73) Assignee: ARC'TERYX EQUIPMENT INC., North Vancouver, British Columbia (CA)

( * ) Notice: Subject to any disclaimer, the term of this patent is extended or adjusted under 35 U.S.C. 154(b) by 1153 days.

(21) Appl. No.: 12/190,195

(22) Filed: Aug. 12, 2008

(65) Prior Publication Data

US 2010/0037362 A1 Feb. 18, 2010

(51) Int. Cl.

*A41D 19/00* (2006.01)
*A41D 19/015* (2006.01)
*A41D 19/02* (2006.01)

(52) U.S. Cl.

CPC ..... *A41D 19/015* (2013.01); *A41D 19/02* (2013.01); *A41D 2300/50* (2013.01); *A41D 2400/22* (2013.01)

(58) Field of Classification Search

CPC ..... A41D 19/015; A41D 19/02
USPC ..... 2/159, 161.1, 161.3, 161.5, 161.6, 161.8,2/163, 167, 169
See application file for complete search history.

(56) References Cited

U.S. PATENT DOCUMENTS

| | | | | | |
|---|---|---|---|---|---|
| 199,738 | A | * | 1/1878 | Parker | 2/163 |
| 1,252,900 | A | * | 1/1918 | Grinnell | 2/169 |
| 1,377,338 | A | | 5/1921 | Grinnell | |
| 2,447,951 | A | * | 8/1948 | Lindfelt | 2/167 |
| 2,864,091 | A | * | 12/1958 | Schneider | 2/2.5 |
| 3,258,782 | A | * | 7/1966 | Turnidge et al. | 2/161.6 |
| 3,366,973 | A | | 2/1968 | Israel | |
| 3,703,007 | A | * | 11/1972 | Stewart | 2/163 |
| 4,453,275 | A | | 6/1984 | Kawada | |
| 4,654,896 | A | * | 4/1987 | Rinehart | 2/163 |
| 4,733,413 | A | * | 3/1988 | Dykstra | 2/169 |
| 4,987,614 | A | | 1/1991 | Stongwater | |
| 5,568,656 | A | * | 10/1996 | Kim | 2/164 |
| 5,659,899 | A | * | 8/1997 | Soter et al. | 2/160 |
| 5,682,614 | A | * | 11/1997 | Lazarus | 2/169 |
| 5,752,279 | A | * | 5/1998 | Hochmuth | 2/161.1 |
| 5,774,897 | A | * | 7/1998 | Hochmuth | 2/161.1 |
| 6,094,748 | A | * | 8/2000 | Kindler | 2/167 |
| 6,415,447 | B1 | * | 7/2002 | Frazier | 2/165 |
| 7,287,285 | B2 | | 10/2007 | Jaeger et al. | |
| 2004/0031085 | A1 | * | 2/2004 | Widdemer | 2/161.2 |
| 2004/0250335 | A1 | * | 12/2004 | Jaeger et al. | 2/161.6 |

FOREIGN PATENT DOCUMENTS

| | | | |
|---|---|---|---|
| GB | 996815 | A | 6/1965 |
| WO | WO-99/64240 | A1 | 12/1999 |

OTHER PUBLICATIONS

U.S. Appl. No. 12/689,928 (Green et al.), filed Jan. 19, 2010.

* cited by examiner

*Primary Examiner* — Sally Haden
(74) *Attorney, Agent, or Firm* — Greenblum & Bernstein, P.L.C.

(57) ABSTRACT

The invention is directed to a waterproof glove that includes an outer shell having several finger shells. At least one finger shell includes first, second, and third tongues, the first tongue forming the palm portion of the finger shell, and the second and third tongues forming the back and side portions of the finger shell. The tongues are joined together at their adjacent edges. The glove further includes waterproof strips overlapping the adjacent edges and fastened to the edges.

25 Claims, 4 Drawing Sheets

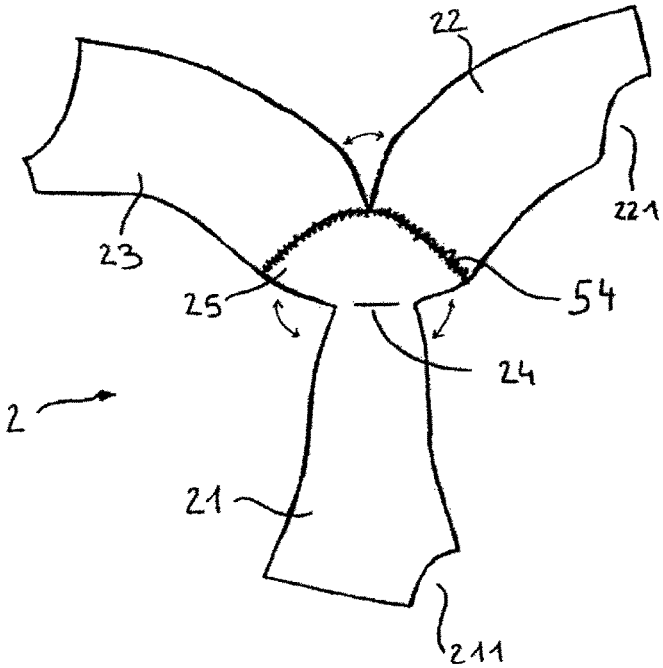
Fig. 6
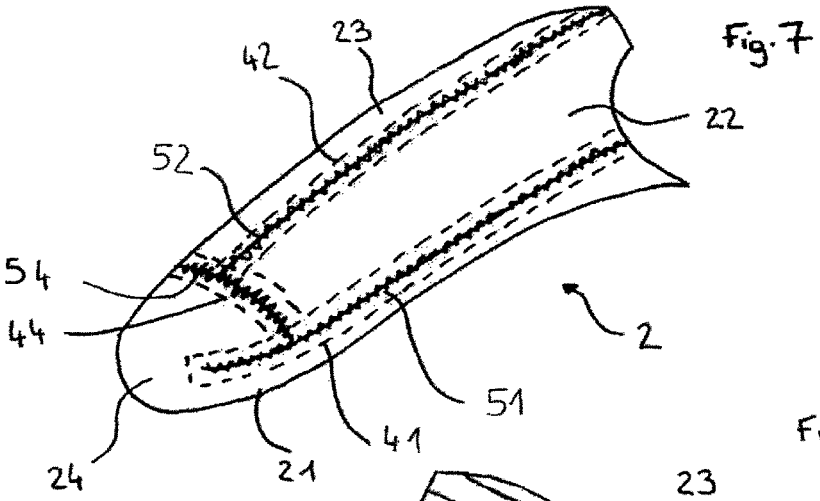
Fig. 7
Fig. 8
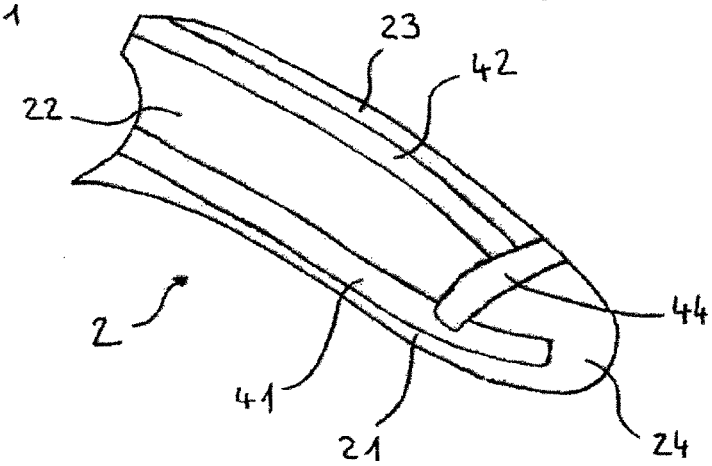

GLOVE

BACKGROUND OF THE INVENTION

1. Field of the Invention

The present invention relates to gloves and, more particularly, to waterproof gloves and to a process of manufacturing such gloves.

2. Description of Background and Other Information

Waterproof or waterproof breathable gloves are required especially for mountain activities, such as climbing, skiing, and the like, as well as for miscellaneous other outdoor activities. Such gloves typically comprise an outer shell composed of several portions of leather or fabric sewn together at their edges. Several of such edges intersect in the area of the distal end of each finger. Because sewn edges inherently form entry points for water and moisture inside the outer shell, such gloves typically include an inner waterproof sheath. Such a lining is designed to enclose the user's hand. The finger tips of the lining provide protruding portions sewn to the shell. The walls of the lining are attached to the outer shell to delimit an inner volume. Padding is then attached inside the lining. The padding provides an improved comfort for the user and provides thermal isolation.

Such a glove suffers from several drawbacks. Because water or moisture can enter through the outer shell, the thermal isolation provided by the glove is weakened. Moreover, the cost of the waterproof or waterproof-breathable lining is relatively high. If the lining is pierced during a sewing phase, the glove is no longer waterproof. Due to its waterproofing process, including a PTFE coating step, the lining is required to be made out of two flat fabric layers joined together by bonding, such as adhesive bonding. The lining basically is made out of two flat layers having the general contour of the hand that are joined together at their respective edges, leaving an opening for insertion of the hand. Because of the flat structure of the two layers, the layers are easy to assemble, by welding, for example, thereby ensuring a waterproof assembly of the two layers. The lining then adopts a three-dimensional shape inside the outer shell. In order to delimit a suitable inner volume, a very large flat lining is initially required. In its three-dimensional shape, the lining then presents several pleats, or folds, in the area of the finger tips. The finger tips then suffer from a loss of tactile sense, making it difficult for the wearer to pick up small objects, such as coins. The finger flexibility is thereby also reduced. Seams located at the distal end of the finger shell also lead to a loss of tactile sense and to a poor appearance. Due to its loss of tactility and due to its limited finger flexibility, such a glove is not appropriate for sports such as climbing, skiing, etc. Moreover, in order to adapt to the morphology of the hand, a three-dimensional shape is required for the outer shell, which then requires complicated seam contours. Such seam contours require a complicated manufacturing process.

In the garment manufacturing field, it is known to seal and waterproof an assembly line between two panels by overlapping the assembly line with a waterproof strip. The assembly line can be a stitched line, an adhesive line, or a welded line. Using this technology, a flat assembly is much easier to waterproof than a three-dimensional assembly. In the manufacturing of garments larger in size than gloves, the waterproofing of three-dimensional structures remains possible because the size of the various panels that are to be assembled always make it possible to "flatten" the assembly line for a certain area or for a certain length. The manufacturing of tight-fitting gloves requires the assembly of various small panels. Furthermore, when assembled together, these panels often define an acute angle between each other. This is especially the case at the finger distal end and at the finger crotch, i.e., the part of the hand that corresponds to the junction of two fingers with the remainder of the hand.

There is thus a need for a glove overcoming the aforementioned drawbacks.

SUMMARY OF THE INVENTION

The invention provides a waterproof or waterproof-breathable glove that does not require a flat waterproof lining, or sheath, in its construction.

In addition, the invention provides a waterproof or waterproof-breathable glove that increases finger tactility.

Further, the invention provides a waterproof or waterproof-breathable glove that permits the area at the tip of the finger to be smooth.

Still further, the invention provides a waterproof or waterproof-breathable glove that has a closer fit to conform the hand of the user, and more particularly an anatomically correct fit.

Still further, the invention provides a waterproof or waterproof-breathable glove with enhanced aesthetic qualities.

Moreover, the invention provides the above-mentioned capabilities and advantages in a construction of a glove that is relatively simplified, as will become apparent from the description herein.

To these and other ends, the invention provides a waterproof or a waterproof-breathable glove that includes an outer shell comprising a plurality of finger shells, at least one finger shell including first, second, and third tongues, the first tongue forming the palm portion of the finger shell, the second and third tongues forming the back and side portions of the finger shell, with the tongues being joined together at their adjacent edges, the glove further including waterproof strips overlapping the adjacent edges and fastened to such edges.

In a particular embodiment, the first and second tongues are joined together by their adjacent edges located on a first side portion of the finger shell, the first and third tongues being joined together by their adjacent edges located on a second side portion of the finger shell, and the second and third tongues being joined together by their adjacent edges located on the back portion of the finger shell.

According to an embodiment, the three tongues are formed unitary from a common material.

According to another embodiment, the first, second, and third tongues are independent elements joined together. The first tongue can be made from leather and the second and third tongues can be made from fabric.

According to a particular embodiment, the three tongues are made from a waterproof or a waterproof-breathable material, or a stacked structure of multiple layers, such as layers of different materials.

The glove may include a padding delimiting an inner volume for receiving a user's hand, the padding being fastened to the outer shell and being enclosed inside the outer shell.

According to a particular embodiment, the waterproof strips are made from fabric covered by an adhesive material.

According to another particular embodiment, the waterproof strips are made out of a hot-melt adhesive material.

In a particular embodiment, the glove further includes a junction portion formed unitary with the first tongue and forms the back portion of the tip of the finger shell, the junction portion being folded over the first tongue, and the first tongue and the junction portion being joined together at their adjacent edges.

In a particular embodiment, the adjacent tongue edges are sewn together, the seams being covered by said waterproof strips.

In further embodiments the adjacent tongue edges are bonded or welded together.

The folding line of the junction portion may be located at the distal end of the finger shell, this distal end thereby having no seam, i.e., no stitching or other seam.

The tongue edges, in a particular embodiment, extend lengthwise of the finger shell.

Further consistent with particular aspects of the invention, the invention also provides a waterproof or waterproof-breathable glove having an outer shell including several finger shells, wherein two adjacent finger shells are joined together at a finger crotch by respective C-shaped edges, the glove further including a sealing component overlapping the adjacent edges and fastened to such edges, the sealing component being made out of a hot-melt adhesive material.

The C-shaped edges may extend from the palm portion below the finger crotch into the back portion of the outer shell below the finger crotch.

The C-shaped edges may be located in a plane longitudinal to the hand and perpendicular to the plane of the hand.

The invention also includes a method for manufacturing a waterproof or waterproof-breathable glove having several finger shells, such method including the following: forming a finger shell based on a pattern that includes first, second, and third tongues, by joining together these three tongues by their adjacent edges, the first tongue then forming a palm portion of the finger shell, the second and third tongues thus forming the back and side portions of the finger shell; fastening waterproof strips overlapping the adjacent edges; and fastening the finger shell to palm and back portions of the glove.

BRIEF DESCRIPTION OF DRAWINGS

Other characteristics and advantages of the invention will be better understood from the description that follows, with reference to the annexed drawings showing, by way of non-limiting embodiments, how the invention can be made, and in which:

FIG. 6 is a top view of a glove finger pattern according to a second embodiment of the invention;

FIG. 7 is a perspective view of the assembled glove finger of FIG. 6;

FIG. 8 is a perspective view of the finger of FIG. 7 turned inside-out;

DETAILED DESCRIPTION OF THE INVENTION

The invention is directed to a waterproof or waterproof-breathable glove comprising an outer shell including several finger shells. A finger shell comprises first, second, and third tongues. The first tongue forms the palm portion of the finger shell, the second and third tongues form the back and side portions of the finger shell. The tongues are joined together at their adjacent edges. Waterproof strips overlap the adjacent edges and are fastened to these edges.

Such a finger shell structure provides several advantages. A three-dimensional finger shell is obtained through the use of the three tongues. The finger shell is thus well adapted to the shape of the hand, i.e., to the hand morphology. Moreover, the three tongues limit the number and the complexity of the seams of the finger shell. Thus, the fastening of the waterproof strips is facilitated because the finger shell can be easily flattened. The finger shell can be typically flattened in the area of the seam along a length at least greater than 20 millimeters and, in certain embodiments, greater than 30 millimeters.

A waterproof sheath, or lining, therefore becomes unnecessary with the construction of the invention. Thus, the manufacturing costs of the glove are reduced and finger flexibility is improved. Moreover, no seam is present in the tip portion of the finger shell. Thus, the sense of feel and the flexion capacity of the finger are improved.

Figure 1:
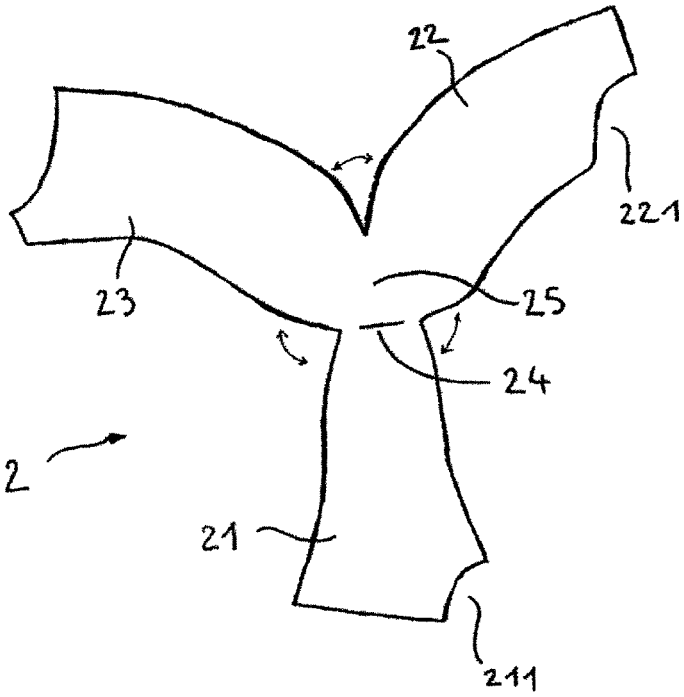
FIG. 1 is a top view of a glove finger pattern according to a first embodiment of the invention.
Figure 2:
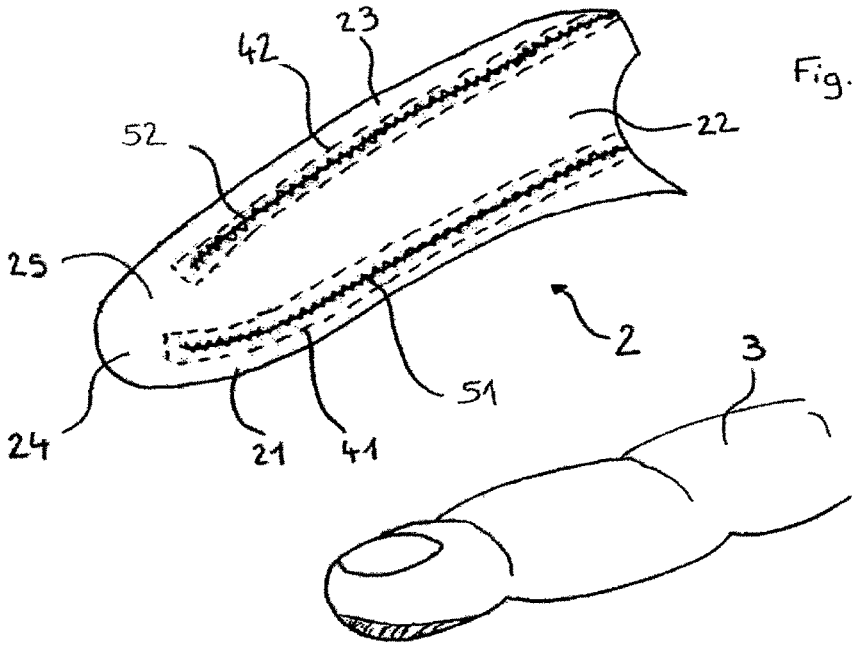
FIG. 2 is a perspective view of the assembled glove finger of FIG. 1.

FIG. 1 illustrates a pattern of a single piece of material used to form a finger shell 2. The pattern includes a first tongue 21, a second tongue 22, and a third tongue 23. The tongues 21, 22, 23 extend from a common junction portion 25 to form a Y shape. By joining together the adjacent edges of the tongues 21, 22, 23 of the Y-shaped pattern, the three-dimensional shape of the finger shell 2 illustrated at FIG. 2 is obtained. Thus, the three tongues of the finger shell 2 have a combined surface area that is structured and arranged to extend transversely around and entirely enclose a wearer's finger. A wearer's finger 3 is illustrated beside the finger shell to highlight its orientation.

An edge of the tongue 21 overlaps an edge of the tongue 22. An edge of the tongue 21 overlaps an edge of the tongue 23. An edge of the tongue 22 overlaps an edge of the tongue 23. These overlapping edges are sewn together in the illustrated embodiment. Each pair of adjacent edges thus presents a seam extending lengthwise of the finger shell 2. A seam 51 notably joins tongue 21 and tongue 22 on one side of the finger shell 2, thereby forming a first longitudinally extending lateral seam. A seam 52 joins tongue 22 and tongue 23 on the back portion of the finger shell 2. Such a location of the seam 52 allows for an easy creation of variable cross sections of the finger shells, by just increasing the widths of tongues 22 and 23 for larger sizes. A lateral seam 53 (shown in FIG. 5 not illustrated) joins tongue 21 and tongue 23 on another side of the finger shell 2, thereby forming a second longitudinally extending lateral seam. In the illustrated embodiment, the seams are located inside the glove to improve its appearance. As is evident from FIG. 2, as well as FIG. 5, each of the seams extends longitudinally and terminates at a free end. That is, the distal end of each of the seams does not intersect with another seam nor is it continuous with another seam. In the embodiment described below with reference to FIGS. 6, 7, and 8, the two lateral seams terminate at free ends, whereas the back seam 52 terminates at a transverse seam 54.

Figure 3:
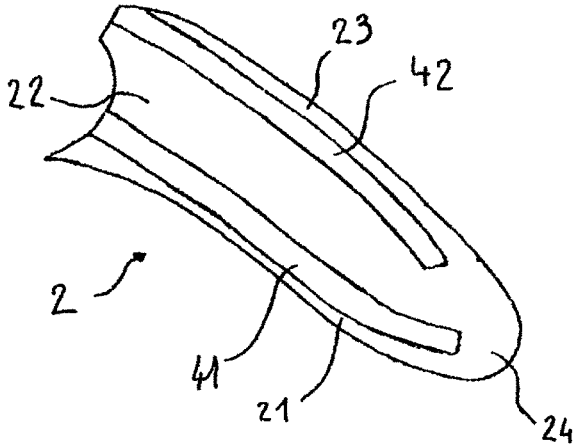
FIG. 3 is a perspective view of the finger of FIG. 2 turned inside-out.
Figure 13:
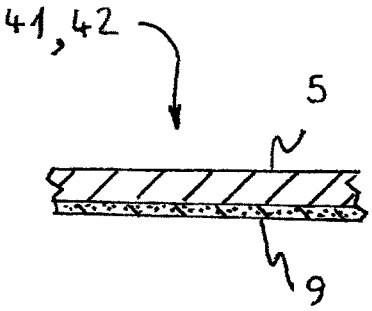
FIG. 13 is partial longitudinal cross section, enlarged for clarity, of a particular embodiment of a waterproof strip, made of fabric covered by an adhesive layer.

FIG. 3 illustrates the finger shell 2 when turned inside out. In order to seal the finger shell against water, the adjacent edges are overlapped by waterproof strips. The waterproof strip 41 overlaps and is fastened to the adjacent edges of tongues 21 and 22. The waterproof strip 42 overlaps and is fastened to the adjacent edges of tongues 22 and 23. A waterproof strip (not illustrated) overlaps and is fastened to the adjacent edges of tongues 21 and 23. The waterproof strips, according to a particular embodiment, as shown in FIG. 13, can be made of fabric 5 covered by an adhesive layer 9, such as a hot-melt adhesive, for instance. The waterproof strips can also be made out of a waterproof material fused in contact with the adjacent edges. In a particular embodiment, the integrality of the contact surface of the waterproof strips adhere to the edges and to the seams.

In this embodiment, the tongues 21, 22, 23 are formed unitary out of a single material, i.e., from one and only one piece of material, which reduces the number of seams and increases the finger shell durability. Moreover, the junction portion 25 is one-piece with each of the first, second, and third tongues. This material can be leather or an appropriate waterproof synthetic material, or even a laminated structure of multiple layers, such as several different layers. The tongues of such singular material, if leather, can have leather edges that would be joined together at the aforementioned seams.

The junction portion 25 is advantageously formed unitary (i.e., in one piece) with the first tongue 21. The junction portion 25 is folded over the first tongue 21. Thus, the junction portion 25 forms the back portion of the tip 24 of the finger shell 2. Adjacent edges of the junction portion 25 and of the first tongue 21 overlap. These edges are joined together by the same seams that join together tongues 22 and 23 to tongue 21. These edges are also overlapped by the above-mentioned waterproof strips. The folding line of the junction portion 25 relative to the first tongue 21 is located at the distal end 24 of the finger shell. Thus, the distal end of the finger shell 2 is smooth and rounded and has no seam. That is, the surface of the finger shell extending from the palm portion, i.e., from the first tongue 21, across the distal end or tip 24 of the finger shell, and away from the distal end within the junction portion 25 is continuous, i.e., the surface is not interrupted by an edge or a seam. This increases the sense of feel for the user when the glove is worn, as well as the appearance of the glove. The folding line of the junction portion is practically the extension of the seam 51. Such a junction also allows flattening the finger tip 24, which is typically a portion where seams are difficult to form. The fastening of the waterproof strips at the finger tip is thereby made easier with the invention. The lateral seams can end approximately in the area of the base of the finger nail, illustrated by a cross at FIG. 2. With the illustrated embodiment, as the glove is worn, the lateral seams end at least 10 millimeters before the distal end of the finger shell, so that finger tactility can be increased.

As can be seen, none of the seams forms an acute angle. The seams are almost linear, i.e., almost straight. Thus, linear waterproof strips can be used and can easily be fastened on the finger shells.

The finger shell 2 illustrated at FIGS. 1 to 3 is designed for the index finger of the left hand. An arcuate cutout 211 is made in tongue 21. Similarly, an arcuate cutout 221 is made in tongue 22. When tongues 21 and 22 are joined together, cutouts 211 and 221 form a C-shaped edge in the area of the finger crotch, as explained below with reference to FIG. 10. This C-shaped edge can be fastened to a corresponding adjacent edge of a finger shell designed for a middle finger, as also explained below, at a seam 55 covered with a sealing component 8.

Figure 4:
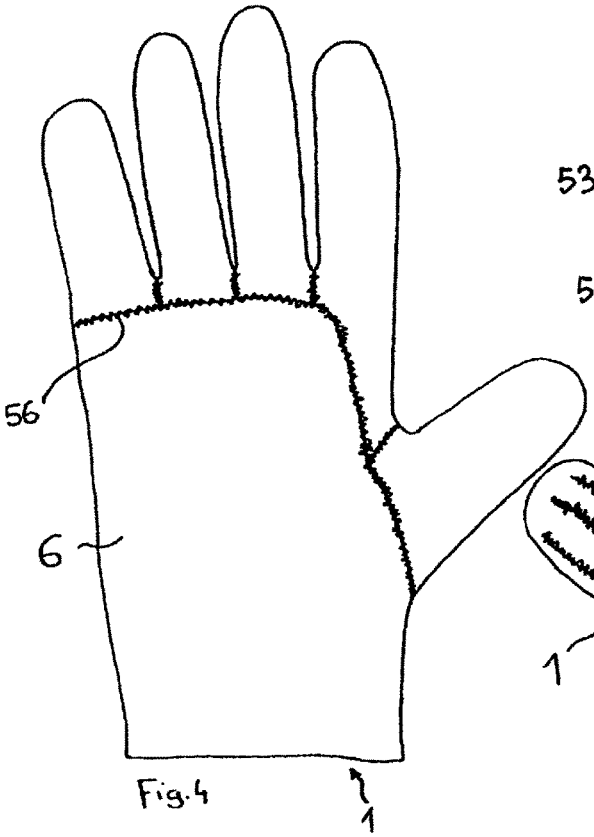
FIGS. 4 and 5 are respectively bottom and top views of a glove including several fingers according to FIGS. 2 and 3.
Figure 5:
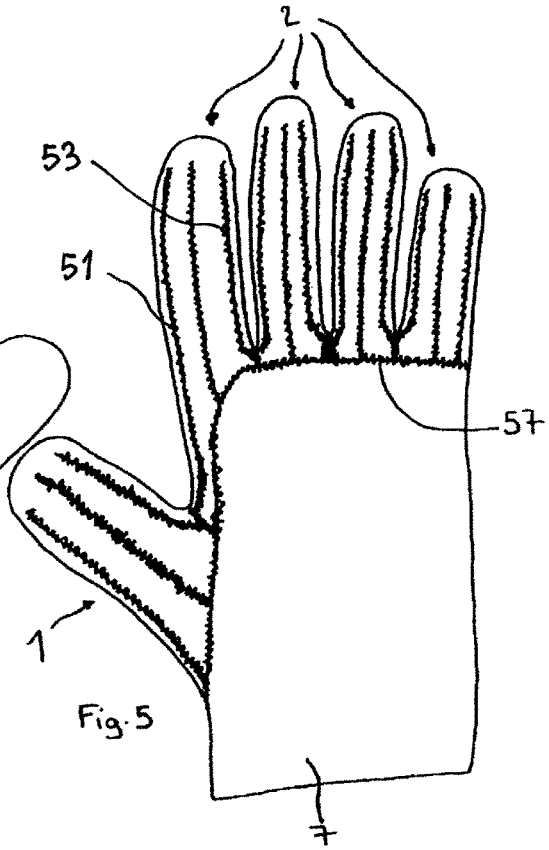

FIGS. 4 and 5 are respectively bottom and top plan views of a glove 1. Adjacent finger shells 2 are joined together. The finger shells 2 are fastened to a palm portion 6 and to a back portion 7 through respective seams 56 and 57. Waterproof strips (not illustrated) are located inside the glove and cover the seams 56 and 57. Further, as mentioned above, and as shown in FIG. 4, for a substantial length of the finger shells, i.e., from their distal ends toward their proximal ends, the latter being joined together as shown in FIGS. 4 and 5 and further described below, no seam joining together the tongues is present in the palm portion of the finger shell. In the top plan view of FIG. 5 showing the back portion of the finger shells, the first and second lateral seams 51 and 53 are visible.

Figure 12:
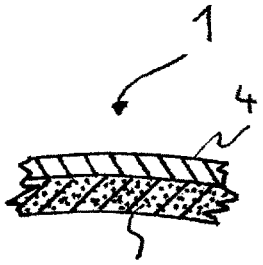
FIG. 12 is a partial cross section of the glove, on an enlarged scale, showing a padding positioned inside the outer shell of the glove.

The glove 1 may include padding 58, as shown schematically cross section in FIG. 12, e.g., inside the outer shell 4 in order to improve the thermal protection. The padding delimits an inner volume for receiving the user's hand. The padding is fastened to the outer shell, for instance by bonding, i.e., such as adhesive bonding.

FIGS. 6 to 8 illustrate another embodiment of the finger shell structure. Because of the pattern illustrated in FIG. 6, the material yield is significantly improved, that is, less material is required for manufacturing the glove, because the tongues 21, 22, and 23 are almost linear and can be made by individual cut-out pieces. Tongue 21 is made from leather, whereas tongues 22 and 23 are made from a waterproof fabric. The junction portion 25 is advantageously formed unitary (i.e., one-piece) with the first tongue. Thus, the tip 24, or folding line, of the finger shell 2 is free of a joining seam, which increases the sense of feel for the user. Tongues 22 and 23 are fastened to the junction portion 25 by a seam 54, i.e., such as stitching. As illustrated in FIG. 8, the seam 54 is covered by a waterproof strip 44 located inside the glove 1. In the embodiment of FIGS. 6-8, like the previously described embodiment, other than having longitudinal edge seams, such as seams 51 and 52, the tongues 21, 22, and 23 are otherwise longitudinally seamless and entirely surround the wearer's finger.

Figure 9:
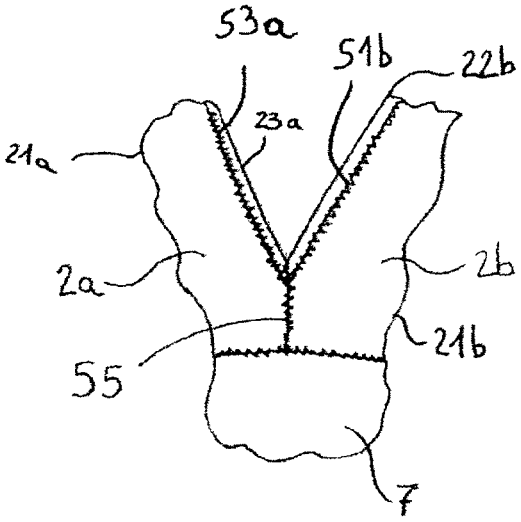
FIG. 9 is a bottom view of a glove portion at the junction between two fingers and the palm.
Figure 10:
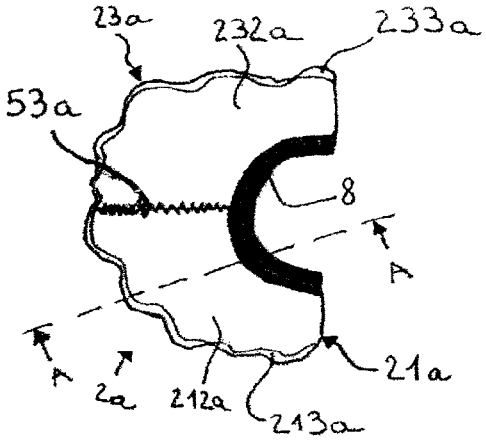
FIG. 10 is a side view of the glove portion of FIG. 9.
Figure 11:
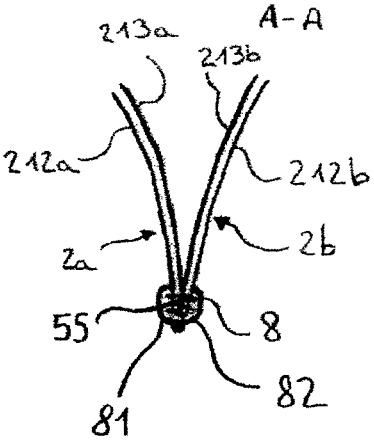
FIG. 11 is a cross section of the glove portion of FIG. 9, taken along lines 11-11.

FIGS. 9 to 11 illustrate the fastening of adjacent finger shells together at the finger crotch. Finger shells 2*a* and 2*b* are fastened to a glove back portion 7. Finger shells 2*a* and 2*b* have overlapping edges sewn together at the finger crotch through the seam 55. These edges each being made by means of joined cutouts of adjacent tongues, like cutouts 211, 221 of tongues 21, 22, e.g., as mentioned above, are both C-shaped in order to fit to the finger crotch morphology. With reference to the hand positioned along a vertical plane, these edges extend from the palm portion, below the finger crotch, into the back portion of the outer shell, below the finger crotch. In an exemplary embodiment, these edges start at least 5 millimeters beyond the finger crotch; in another exemplary embodiment, they start at least 10 millimeters beyond the finger crotch, and, in yet another exemplary embodiment, they start at least 15 millimeters beyond the finger crotch. As illustrated, a sealing component 8 is located inside the glove and encloses the seam 55 and the C-shaped edges. The sealing component 8 is made out of a waterproof material or substance. Because waterproof tape might not well conform to the C-shaped edges, although encompassed by the invention, the sealing component 8 can be made from two C-shaped strips 81 and 82 made out of a hot-melt adhesive. The strips 81 and 82, in the illustrated embodiment, have the same shape. The C-shaped strips 81 and 82 can notably be made out of urethane. Each strip 81 or 82 has a portion covering a C-shaped edge and the seam 55, and a portion covering a portion of the other C-shaped strip. During assembly of the glove, the strips 81 and 82 are pressed and heated until they are joined together and are joined to their respective C-shaped edges. Once the strips 81 and 82 are joined, the protruding portion is folded back over one of the edges and heat pressed again, in order to avoid such protruding portion being a source of irritation or discomfort for the wear at the finger crotch. The strips 81 and 82 are fastened to the finger shells 2*a* and 2*b* after the tongues defining the C-shaped edges have been joined together.

Due to the sealing component 8 being made out of two C-shaped strips 81 and 82, the fastening of the finger shells at the finger crotch is made much easier. To further facilitate the fastening of the strips 81 and 82, the C-shaped edges are located in a plane perpendicular to the plane of the hand. In a particular embodiment, this plane extends longitudinally along the hand.

An appropriate pressing and heating tool will preferably have a shape that will limit the width of the portions of the strips 81 and 82 overlapping each other. The sealing component 8 will thus have a shape and a contact surface unlikely to be uncomfortable at the area of the user's finger crotch.

The finger shells 2*a* and 2*b* advantageously comprise two overlapping layers. The outer layer can be made out of leather to provide grip and abrasion resistance. The inner layer can be a waterproof moisture-permeable fabric, thus providing weather resistance and perspiration evacuation. Tongue 23*a* comprises an inner fabric layer 232*a* and an outer leather layer 233*a*. Tongue 21*a* comprises an inner fabric layer 212*a* and an outer leather layer 213*a*. Tongues 21*a* and 23*a* are joined together by the seam 53*a*. Tongue 21*b* comprises an inner fabric layer 212*b* and an outer leather layer 213*b*. Tongue 21*b* and tongue 22*b* are joined together by the seam 51*b*.

The stitching of the various panels that constitute the glove can be replaced by any other method of bonding, e.g. welding, gluing.

The invention claimed is:

1. A waterproof or waterproof breathable glove comprising:

an outer shell comprising a plurality of finger shells, at least one finger shell of said finger shells comprising first, second, and third tongues;

the first tongue forming a palm portion of the finger shell;

the second and third tongues forming back and side portions of the finger shell;

the first, second, and third tongues being joined together at respective adjacent edges;

waterproof strips overlapping the respective adjacent edges and being fastened to said respective adjacent edges;

a junction portion formed unitary with the first tongue and forming a tip of the back portion of the finger shell, the junction portion being folded over the first tongue along a folding line;

the first tongue and the junction portion being joined together at adjacent edges.

2. A waterproof or waterproof breathable glove according to claim 1, wherein:

the first and second tongues are joined together at adjacent edges located on a first side portion of the finger shell;

the first and third tongues are joined together at adjacent edges located on a second side portion of the finger shell;

the second and third tongues are joined together at adjacent edges located on the back portion of the finger shell.

3. A waterproof or waterproof breathable glove according to claim 1, wherein:

the junction portion and the first, second, and third tongues are formed as a unitary single piece of material.

4. A waterproof or waterproof breathable glove according to claim 3, further comprising:

a padding delimiting an inner volume for receiving a user's hand and fingers, the padding being enclosed inside the outer shell, including inside each of the plurality of finger shells.

5. A waterproof or waterproof breathable glove according to claim 4, wherein:

the padding is fastened to the outer shell.

6. A waterproof or waterproof breathable glove according to claim 1, wherein:

the second and third tongues are independent elements joined to the unitary junction portion and first tongue.

7. A waterproof or waterproof breathable glove according to claim 6, wherein:

the first tongue is made of leather and the second and third tongues are made of fabric.

8. A waterproof or waterproof breathable glove according to claim 1, wherein:

the first, second, and third tongues are made of a waterproof material.

9. A waterproof or waterproof breathable glove according to claim 1, further comprising:

a padding delimiting an inner volume for receiving a user's hand, the padding being fastened to the outer shell and being enclosed inside the outer shell.

10. A waterproof or waterproof breathable glove according to claim 1, wherein:

the waterproof strips are made of fabric covered by an adhesive material.

11. A waterproof or waterproof breathable glove according to claim 1, wherein:

the waterproof strips are made of a hot-melt adhesive material.

12. A waterproof or waterproof breathable glove according to claim 1, wherein:

said adjacent tongue edges are joined together by means of stitching, said stitching being covered by said waterproof strips.

13. A waterproof or waterproof breathable glove according to claim 1, wherein:

the folding line of the junction portion is located at a distal end of the finger shell, said distal end thereby having no seam.

14. A waterproof or waterproof breathable glove according to claim 1, wherein:

said edges of said tongues extend lengthwise of the finger shell.

15. A waterproof or waterproof breathable glove according to claim 1, wherein:

two adjacent finger shells are joined together at a finger crotch by respective C-shaped edges, the glove further comprising a sealing component overlapping adjacent ones of said C-shaped edges and fastened to said C-shaped edges, the sealing component comprising a hot-melt adhesive material.

16. A waterproof or waterproof breathable glove according to claim 15, wherein:

the C-shaped edges extend from the palm portion below the finger crotch into the back portion of the outer shell above the finger crotch.

17. A waterproof or waterproof breathable glove according to claim 15, wherein:

the C-shaped edges are located in a plane longitudinal to the hand and perpendicular to the plane of the hand.

18. A waterproof or waterproof breathable glove according to claim 1, wherein:

the first tongue and the junction portion are joined together with stitching at said adjacent edges.

19. A waterproof or waterproof breathable glove according to claim 1, wherein:

the second and third tongues are independent elements joined to the unitary junction portion and first tongue with stitching.

20. A waterproof or waterproof breathable glove according to claim 1, wherein:

the junction portion is one piece with each of the first, second, and third tongues.

21. A waterproof or waterproof breathable glove according to claim 1, wherein:

the respective adjacent edges of the first and second tongues are joined at a first longitudinally extending lateral seam;

the respective adjacent edges of the first and third tongues are joined at a second longitudinally extending lateral seam;

each of the first and second lateral seams extends in a direction toward the distal end of the finger shell and terminates at a free end.

22. A waterproof or waterproof breathable glove according to claim 21, wherein:

the free end of each of the first and second lateral seams is spaced at least 10 millimeters from the distal end of the finger shell when the glove is worn.

23. A waterproof or waterproof breathable glove according to claim 1, wherein:

each of said plurality of finger shells comprises a number of tongues extending along a finger shell, said number of tongues enclosing an entire transverse periphery of a wearer's finger;

said number of tongues is no greater than three and no fewer than three, said tongues consisting of said first, second, and third tongues.

24. A method for manufacturing the waterproof or waterproof breathable glove of claim 1, said method comprising:

forming said one said finger shells by joining together said first, second, and third tongues at pairs of said respective edges, the first tongue thus forming the palm portion of said one said finger shells, the second and third tongues thus forming said back and side portions of said one said finger shells;

fastening the waterproof strips overlapping said adjacent edges;

fastening said one said finger shells to palm and back portions of the glove.

25. A waterproof or waterproof breathable glove comprising:

an outer shell comprising a plurality of finger shells, said plurality of finger shells extending longitudinally along respective ones of a wearer's fingers;

at least one finger shell of said plurality of finger shells comprising:

a junction portion extending over a distal end of said one finger shell;

a first tongue, a second tongue, and a third tongue, each of said tongues having a pair of longitudinally extending edges;

each of the first, second, and third tongues extending from the junction portion in a direction longitudinally away from said distal end;

each of the first, second, and third tongues being unitary with the junction portion;

the first tongue forming at least a palm portion of said one finger shell;

the second tongue forming at least a back portion of said one finger shell;

the third tongue forming at least a back portion of said one finger shell;

the first, second, and third tongues being joined together at respective adjacent pairs of said longitudinally extending edges;

said one finger shell having a surface area entirely surrounding a wearer's finger, said finger-surrounding surface area consisting of:

a surface of the first tongue;

a surface of the second tongue;

a surface of the third tongue.

* * * * *